US008710977B2

(12) United States Patent
Gubler

(10) Patent No.: US 8,710,977 B2
(45) Date of Patent: Apr. 29, 2014

(54) LOCK MONITORING

(75) Inventor: Daniel Gubler, Brittnau (CH)

(73) Assignee: CWA Constructions SA, Olten (CH)

( * ) Notice: Subject to any disclaimer, the term of this patent is extended or adjusted under 35 U.S.C. 154(b) by 586 days.

(21) Appl. No.: 12/599,103

(22) PCT Filed: May 5, 2008

(86) PCT No.: PCT/CH2008/000205
§ 371 (c)(1),
(2), (4) Date: Nov. 9, 2009

(87) PCT Pub. No.: WO2008/138154
PCT Pub. Date: Nov. 20, 2008

(65) Prior Publication Data

US 2010/0085183 A1 Apr. 8, 2010

(30) Foreign Application Priority Data

May 10, 2007 (CH) ..... 0763/07

(51) Int. Cl.
*G08B 1/08* (2006.01)
*E05B 73/00* (2006.01)

(52) U.S. Cl.
USPC ..... 340/539.1; 70/14; 340/542

(58) Field of Classification Search
USPC ..... 340/539.1, 10.4, 426.15–426.28, 545.6, 340/539.11, 539.13, 542; 70/14, 209, 63
See application file for complete search history.

(56) References Cited

U.S. PATENT DOCUMENTS

| | | | | |
|---|---|---|---|---|
| 4,163,215 | A * | 7/1979 | Iida | 235/382 |
| 5,005,664 | A * | 4/1991 | Hoffmann | 180/287 |
| 5,119,739 | A * | 6/1992 | Templeton et al. | 105/341 |
| 5,410,301 | A * | 4/1995 | Dawson et al. | 340/5.33 |
| 6,292,432 | B1 * | 9/2001 | Futsuhara et al. | 367/96 |
| 6,441,735 | B1 * | 8/2002 | Marko et al. | 340/542 |
| 7,375,619 | B2 * | 5/2008 | Auerbach et al. | 340/426.15 |
| 7,474,210 | B2 * | 1/2009 | Roberts et al. | 340/568.1 |
| 7,586,397 | B2 * | 9/2009 | Bayley et al. | 340/10.4 |
| 8,069,693 | B2 * | 12/2011 | Powers et al. | 70/14 |
| 2004/0160065 | A1 * | 8/2004 | Stojc | 292/144 |
| 2005/0197844 | A1 * | 9/2005 | Ng et al. | 705/1 |
| 2006/0103524 | A1 * | 5/2006 | Auerbach et al. | 340/545.6 |
| 2006/0220817 | A1 * | 10/2006 | Schofield et al. | 340/447 |
| 2006/0220847 | A1 * | 10/2006 | Lanigan et al. | 340/545.6 |
| 2007/0075852 | A1 | 4/2007 | Schmidt et al. | |
| 2009/0002153 | A1 * | 1/2009 | Berstis et al. | 340/539.11 |
| 2011/0005282 | A1 * | 1/2011 | Powers et al. | 70/63 |
| 2011/0173891 | A1 * | 7/2011 | Laliberte et al. | 49/280 |

FOREIGN PATENT DOCUMENTS

| | | |
|---|---|---|
| BE | 635 054 | 11/1963 |
| DE | 100 59 582 | 6/2002 |
| EP | 1 340 869 | 9/2003 |
| FR | 2 375 420 | 7/1978 |
| WO | 2004 109236 | 12/2004 |

* cited by examiner

*Primary Examiner* — Benjamin C Lee
*Assistant Examiner* — Sigmund Tang
(74) *Attorney, Agent, or Firm* — Oblon, Spivak, McClelland, Maier & Neustadt, L.L.P.

(57) ABSTRACT

The cars of a passenger transport means are provided with a sensor (3) which scans the state of the locking mechanism and with a transponder antenna (5) which is fitted to the outside of the car (1), and the stations (6) contain transmission antennas (7) which poll signals from the transponder antenna in contactless fashion.

8 Claims, 1 Drawing Sheet

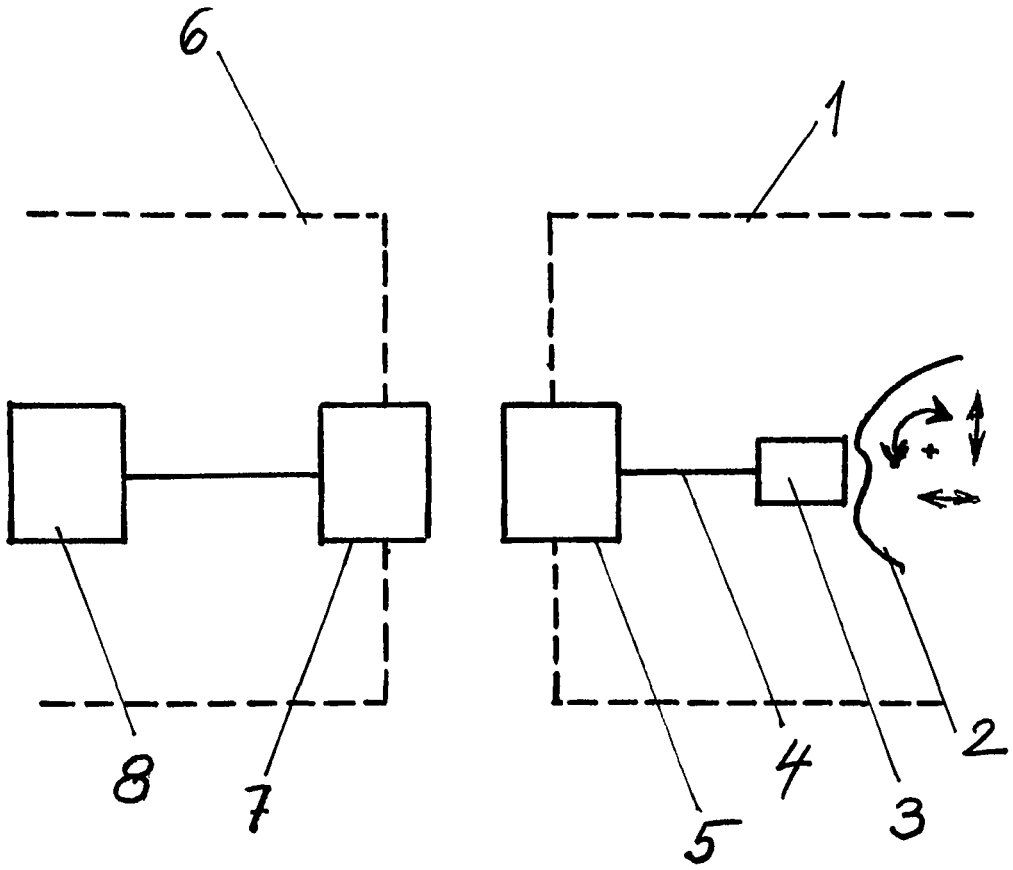
6
1
8
7
5
4
3
2

LOCK MONITORING

The invention relates to a locking monitoring system for doors on passenger transport means, comprising a device, arranged at a station, for sensing the locking state of the doors, and comprising a device, mounted on the cabin, for transmitting the locking state to the sensing device.

Cabin doors of passenger transport means, particularly those in which there are no operating personnel travelling with passengers in the individual cabins, such as, for example, cableways, must be secured against unintentional or improper opening. This is effected in that, after the doors have been closed, the door is locked in the departure station, and is opened again in the arrival station. This locking must be monitored, in order that the departure of a cabin in which the door has only been closed, but has not been locked, can be prevented.

At present, the monitoring of the locking of cableway cabins is effected by means of a mechanical device. The locking position is transferred mechanically onto a scan bar, which projects at an appropriate location on the cabin, where it is scanned in the stations.

The locking segment in the door automatic device is very small, and must be transformed accordingly for the scan bar. This requires a relatively complicated mechanism, which, on the one hand, is expensive and, on the other hand, is susceptible to faults. This is a problem particularly in the case of cableway cabins, which are exposed to extreme weather conditions.

The invention is therefore based on the object of rendering possible a door-locking monitoring system that does not have the disadvantages of the existing solutions.

This is achieved, according to the invention, in that the device for transmitting the locking state comprises a sensor, which scans the state of the locking mechanism and which is connected to a transponder antenna mounted on the outside of the cabin, and in that sending antennas, which contactlessly poll signals from the transponder antenna, are arranged in the stations.

It is also a substantial advantage of the locking monitoring system according to the invention that no voltage source is required on the cabin side for the signal polling.

A preferred exemplary embodiment of the invention is described in the following with reference to the appended drawing. The drawing shows a block diagram of an arrangement for monitoring the door locking of a cableway cabin.

As shown schematically in the drawing, a sensor 3 is arranged on a reference surface 2, for example a cam disc by which the door closure and the locking are determined, in a cableway cabin 1, which sensor polls the position of the reference surface. The sensor 3 may be an end-position switch, an initiator or the like. The sensor is connected, via a line 4, to a transponder antenna 5 mounted on the outside of the cabin, for example on the roof frame. The transponder antenna is preferably arranged on the cabin on the mast side.

Arranged in the stations 6 are sending antennas 7, which are passed, at a distance, by the transponder antennas 5 of the cabins 1 during departure from the station. The switching state of the sensor, and consequently the state of locking, is polled by the sending antennas by means of a polling signal transmitted inductively to the transponder antennas. A signal is emitted from the sender antenna to an evaluation device 8, which prevents the departure of a cabin if locking thereof has not been effected properly.

The invention claimed is:

1. A method of monitoring a locking state of closed doors of a passenger transport cabin prior to leaving a departure station, comprising:

sensing a state of a lock which locks the doors of the passenger transport cabin, when the doors are closed;

transmitting a signal from the cabin to the station which indicates information of the state of the lock; and evaluating the information of the state of the lock and preventing departure of the passenger transport cabin when the doors are determined not to be locked, wherein the sensing of the state of the lock senses the state of the lock which locks the doors of the passenger transport cabin which is a cableway cabin.

2. The method according to claim 1, further comprising:

sending an interrogating signal from the station to the transport cabin which causes said transmitting.

3. The method according to claim 1, wherein:

the transmitting transmits a wireless signal from the cabin to the station.

4. The method according to claim 1, wherein:

the transmitting transmits a wireless signal from an antenna on a roof of the cabin.

5. A system for monitoring a locking state of closed doors of a passenger transport cabin prior to leaving a departure station, comprising:

a locking mechanism which locks the doors of the passenger transport cabin, after the doors of the passenger transport cabin are closed;

a sensor, attached to the passenger transport cabin, which determines a state of the locking mechanism;

a first transmitter which transmits a signal from the cabin to the station which indicates information of the state of the locking mechanism; and an evaluating device to evaluate the information of the locking state and prevent departure of the passenger transport cabin when the evaluating device determines that the doors are not locked, wherein the passenger transport cabin is a cableway cabin.

6. The system according to claim 5, further comprising:

a second transmitter to send an interrogating signal to the first transmitter of the cabin to obtain information of the locking state, wherein the transmitting of the signal from the cabin occurs in response to the sending of the interrogating signal.

7. The system according to claim 6, wherein the first and second transmitters are wireless transmitters.

8. The system according to claim 5, further comprising:

an antenna on a roof of the cabin connected to the first transmitter of the cabin.

* * * * *